US006752510B1

(12) United States Patent
Appiah

(10) Patent No.: US 6,752,510 B1
(45) Date of Patent: Jun. 22, 2004

(54) HEADGEAR WITH ILLUMINATION AND MESSAGE INDICATION MEANS

(76) Inventor: Fredrick K. Appiah, P.O. Box 1944, Watertown, SD (US) 57201

( * ) Notice: Subject to any disclaimer, the term of this patent is extended or adjusted under 35 U.S.C. 154(b) by 36 days.

(21) Appl. No.: 10/122,913

(22) Filed: Apr. 12, 2002

(51) Int. Cl.[7] ..... F21V 21/084

(52) U.S. Cl. ..... 362/106; 362/103; 362/105; 362/473

(58) Field of Search ..... 362/103, 105, 362/106, 157, 190, 191, 208, 459, 473, 475, 476, 540, 543, 544, 545, 546, 549

(56) References Cited

U.S. PATENT DOCUMENTS

| | | | | | |
|---|---|---|---|---|---|
| 2,473,394 | A | * | 6/1949 | Scott | 362/106 |
| 3,577,561 | A | | 5/1971 | Oshima | |
| 3,793,517 | A | | 2/1974 | Carlini | |
| 3,963,917 | A | | 6/1976 | Romano | |
| 4,524,461 | A | | 6/1985 | Kostanty et al. | |
| 4,868,719 | A | * | 9/1989 | Kouchi et al. | 362/545 |
| 4,901,210 | A | * | 2/1990 | Hanabusa | 362/106 |
| 4,945,458 | A | * | 7/1990 | Batts et al. | 362/106 |
| D310,434 | S | | 9/1990 | Breece | |
| 5,207,500 | A | | 5/1993 | Rios et al. | |
| 5,327,588 | A | | 7/1994 | Garneau | |
| 5,353,008 | A | | 10/1994 | Eikenberry et al. | |
| 5,416,675 | A | | 5/1995 | DeBeaux | |
| 5,479,325 | A | * | 12/1995 | Chien | 362/105 |
| 5,508,900 | A | | 4/1996 | Norman | |
| 5,688,039 | A | * | 11/1997 | Johnson | 362/106 |
| D406,400 | S | | 3/1999 | Munns | |
| 6,097,287 | A | | 8/2000 | Lu | |
| 6,157,298 | A | | 12/2000 | Garfinkel et al. | |
| 6,244,721 | B1 | | 6/2001 | Rodriguez et al. | |
| 6,348,859 | B1 | * | 2/2002 | Baker | 362/106 |
| 6,461,015 | B1 | * | 10/2002 | Welch | 362/106 |

* cited by examiner

*Primary Examiner*—Sandra O'Shea
*Assistant Examiner*—Ismael Negron

(57) ABSTRACT

Headgear for increasing the visibility of a wearer of the headgear to other especially in low light or no light conditions. The headgear includes a shell for being worn on the head of the user. The headgear may also include a rear light transmitter on the rear of the shell, a forward light transmitter on the front of the shell, a top light transmitter on the top of the shell, and side light transmitters on each of the sides of the shell. The headgear may also include a message indicator mounted on the shell for displaying alphanumeric characters, and the display of the message indicator maybe oriented in a direction extending rearwardly from the shell for permitting a person behind the wearer to view the display.

24 Claims, 7 Drawing Sheets

HEADGEAR WITH ILLUMINATION AND MESSAGE INDICATION MEANS

BACKGROUND OF THE INVENTION

1. Field of the Invention

The present invention relates to headgear and more particularly pertains to a new headgear with enhanced visibility for increasing the visibility of a wearer of the headgear to others especially in low light or no light conditions.

2. Description of the Prior Art

The use of headgear in the form of protective headgear and illuminated headgear is known in the prior art. Despite the numerous variations that have been disclosed in the prior art, it is believed that the known headgear does not provide optimal visibility for the wearer to those around the wearer, especially in low light or darkness conditions. In circumstances where a person is highly vulnerable to conditions such as moving traffic, the more visibility that a person is able to display to traffic the better for the person's safety. Situations such as when a motorist or motorcyclist is present along the side of a road during a breakdown, or when a law enforcement officer is performing a traffic stop along the side of the road and walking close to traffic. Also, children at play may move around and even through traffic, and enhancement of the visibility of the child is desirable. Further, under some conditions it is desirable not only to enhance the visibility of a person but also to communicate information to those around the person without speaking to those around the person, or where those around are unable to hear any speech of the person. For example, a bicyclist or motorcyclist traveling down a road may desire to communicate with vehicles traveling in the traffic with the cyclist but may find that speaking and/or hand signals are ineffective in communicating with drivers of the other vehicles.

In these respects, the headgear with enhanced visibility according to the present invention substantially departs from the conventional concepts and designs of the prior art, and in so doing provides an apparatus primarily developed for the purpose of increasing the visibility of a wearer of the headgear to others, especially in low light or no light conditions.

SUMMARY OF THE INVENTION

In view of the foregoing, the present invention provides a new headgear with enhanced visibility wherein the same can be utilized for increasing the visibility of a wearer of the headgear to others, especially in low light or no light conditions.

To attain this benefit, the present invention generally comprises a shell for being worn on the head of the user. The headgear may also include a rear light transmitter on the rear of the shell, a forward light transmitter on the front of the shell, a top light transmitter on the top of the shell, and side light transmitters on each of the sides of the shell. The headgear may also include a message indicator mounted on the shell for displaying alphanumeric characters, and the display of the message indicator may be oriented in a direction extending rearwardly from the shell for permitting a person behind the wearer to view the display.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention disclosed herein provides a heretofore unknown level of visibility to the wearer in low light or no light conditions for enhancing the safety of persons in vulnerable positions such as motorists and cyclists on the side of a road, law enforcement personnel conducting traffic stops, and children playing around or alongside traffic. The headgear of the invention is highly suited to visibility in all or virtually all directions around the wearer, and also may provide a means for communicating with those around the wearer when audible communication is difficult or impossible.

The objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
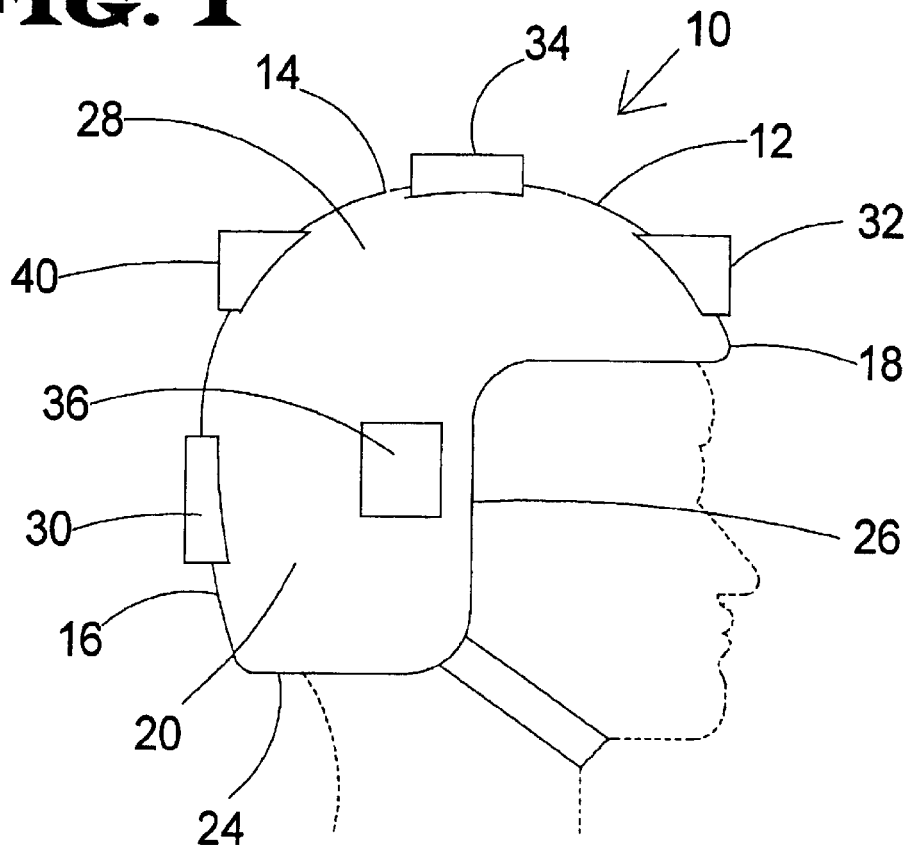
FIG. 1 is a schematic side view of a new headgear with enhanced visibility according to the present invention.
Figure 2:
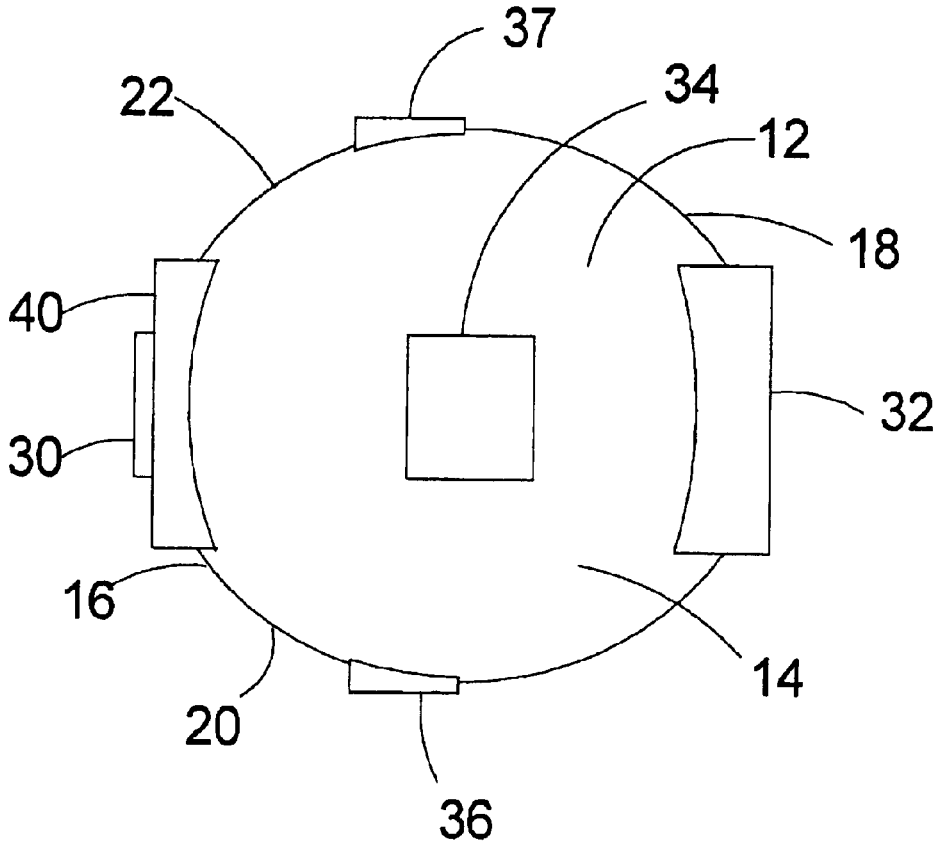
FIG. 2 is a schematic top view of the present invention.
Figure 3:
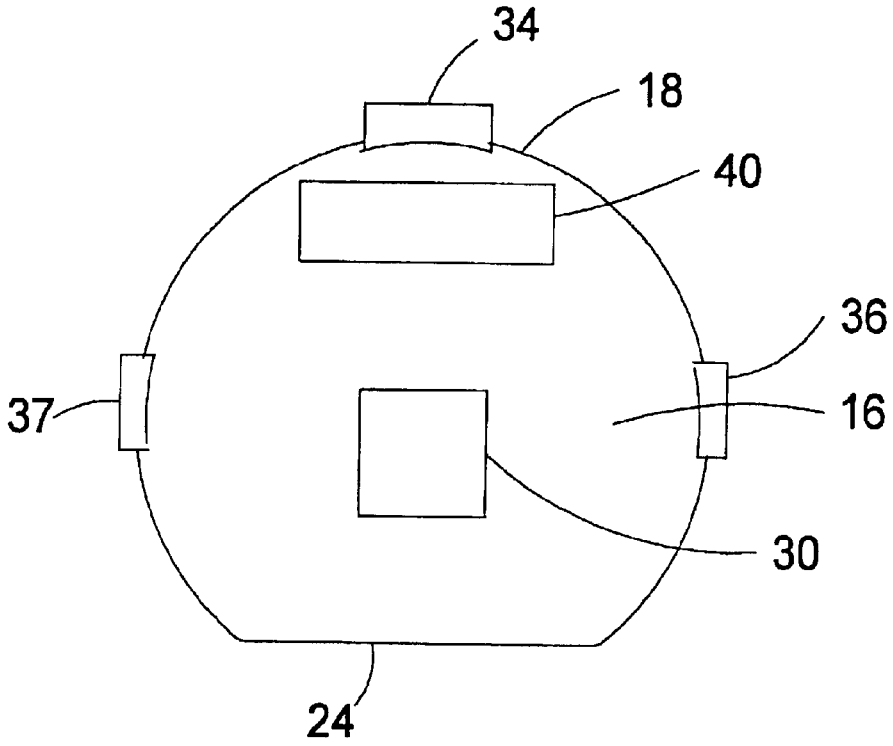
FIG. 3 is a schematic rear view of the present invention.
Figure 4:
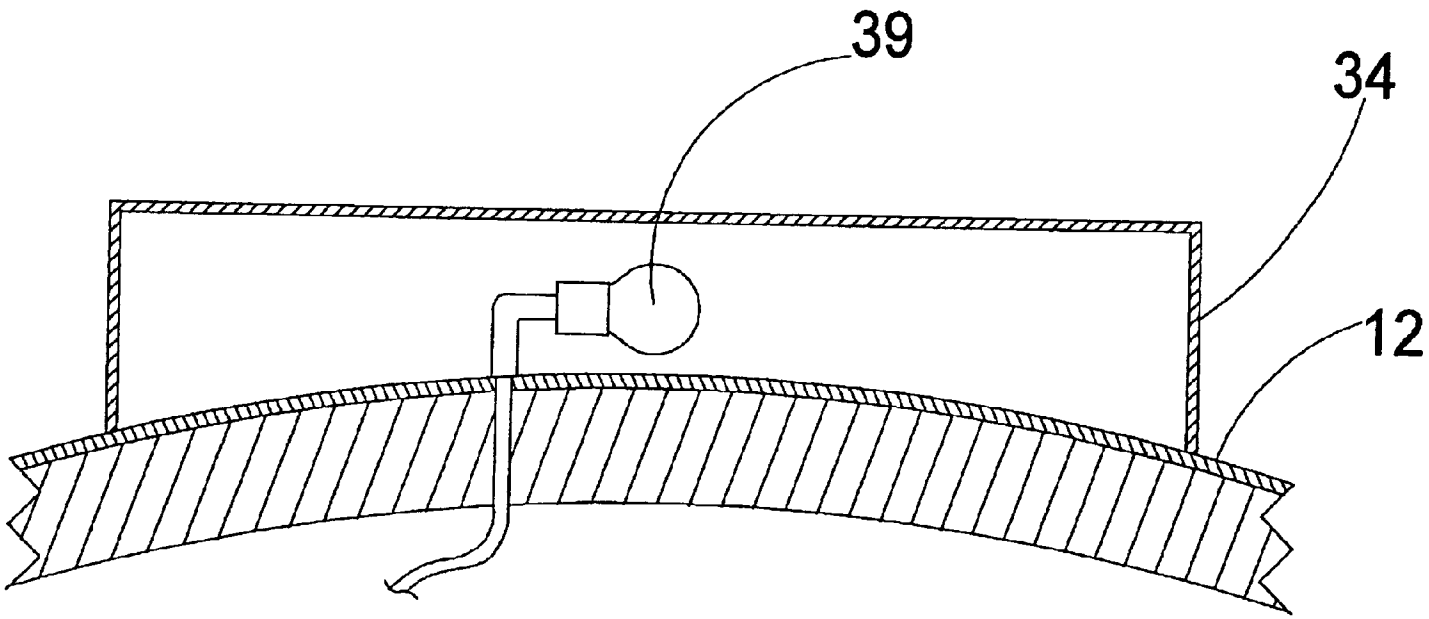
FIG. 4 is a schematic sectional view of one light transmitting assembly of the present invention.
Figure 5:
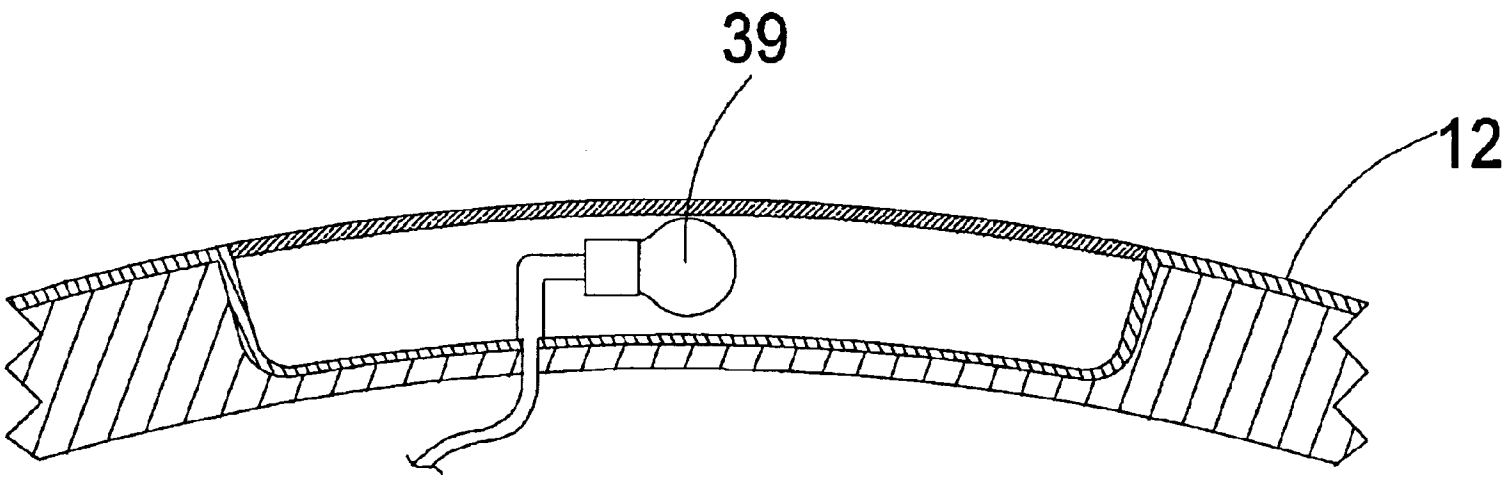
FIG. 5 is a schematic sectional view of one light transmitting assembly of the present invention.
Figure 6:
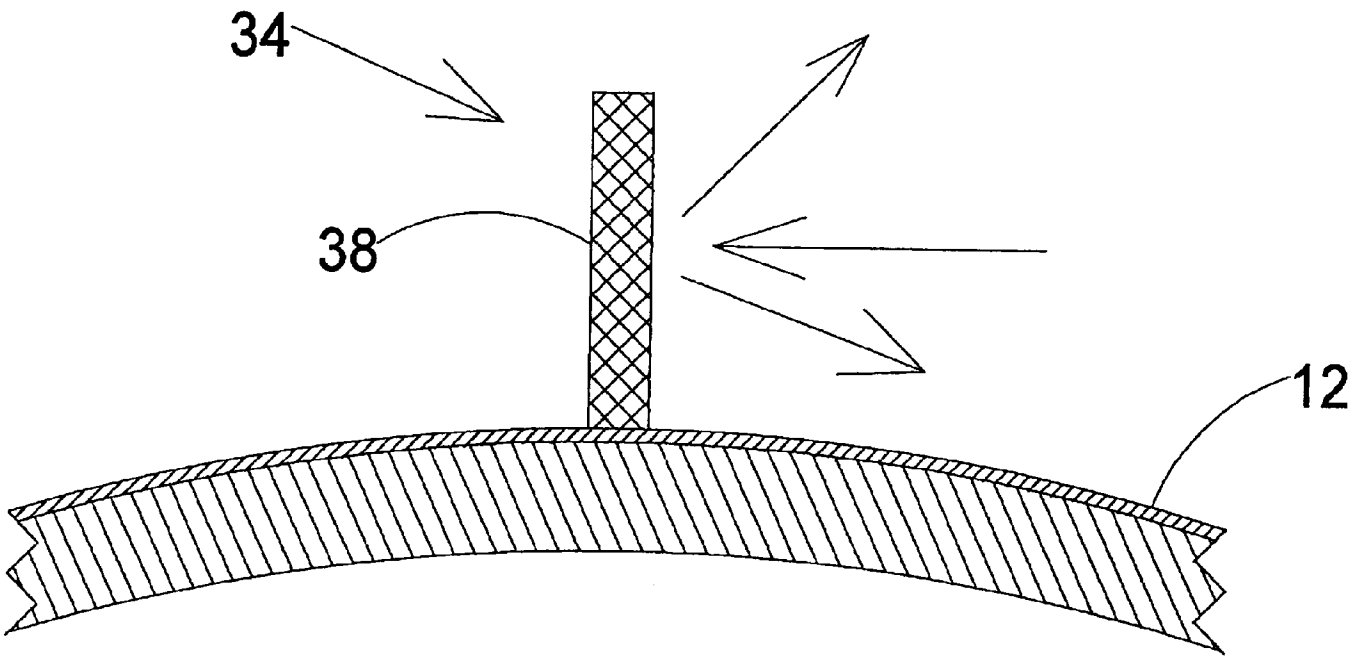
FIG. 6 is a schematic sectional view of one light transmitting assembly of the present invention.
Figure 7:
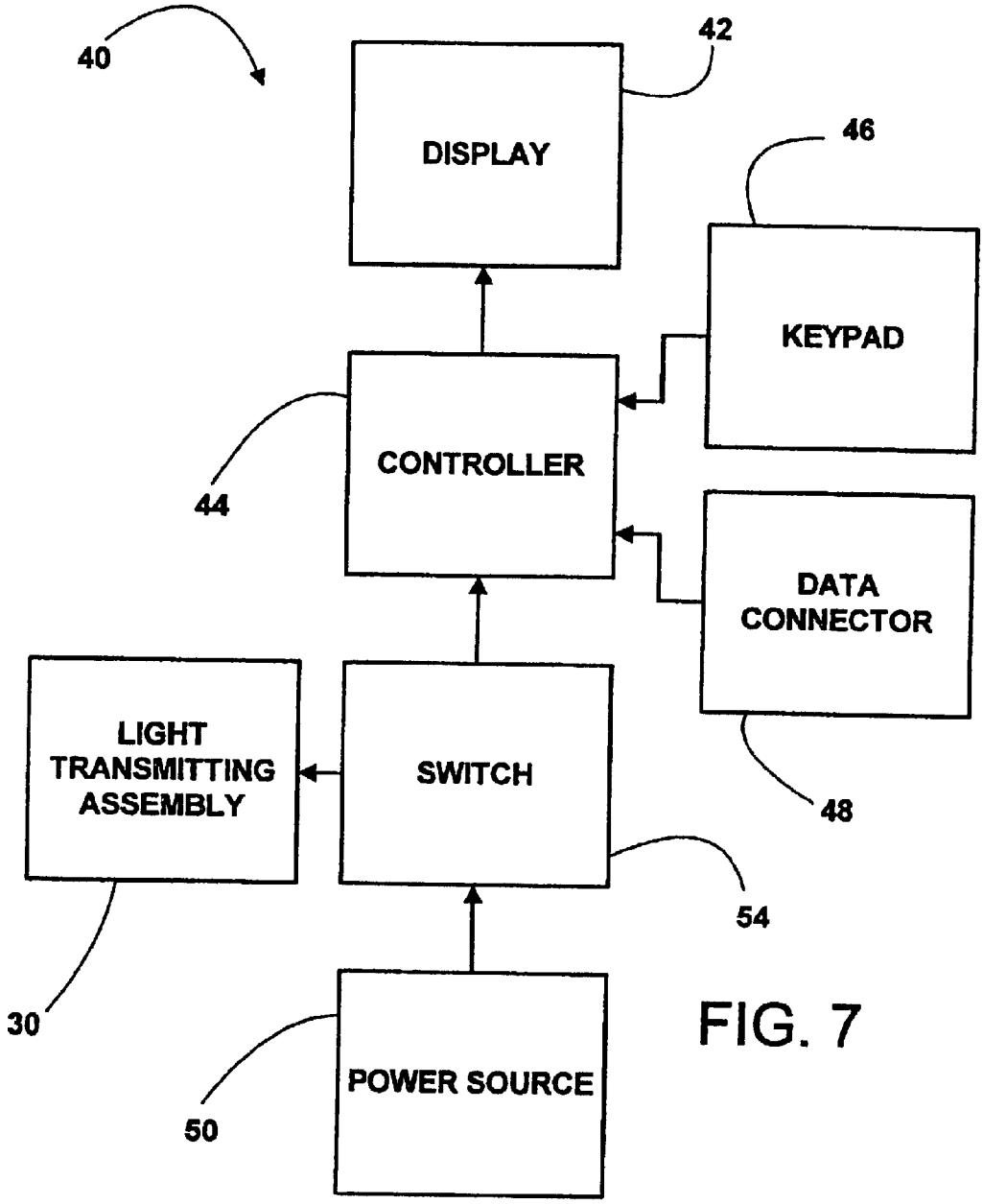
FIG. 7 is a schematic block diagram of the present invention.

With reference now to the drawings, and in particular to FIGS. 1 through 7 thereof, a new headgear with enhanced visibility embodying the principles and concepts of the present invention and generally designated by the reference numeral 10 will be described.

The headgear of the invention may include a shell 12 for being worn on the head of the user of the invention. The shell 12 may have a top portion 14 for positioning adjacent to a top of the head of a wearer when the shell is worn by the wearer. The shell may also include a rear portion 16 that extends downwardly from the top portion for positioning adjacent to a rear of the head of a wearer when the shell is worn by the wearer. The shell may also include a front portion 18 that extends downwardly from the top portion 14, but may extend downwardly a shorter distance than the rear portion 16. Laterally-spaced side portions 20, 22 may also form a portion of the shell 12, and may extend downwardly from the top portion 14 and forwardly from the rear portion 16 for positioning adjacent to sides of the head of the wearer when worn. The shell 12 has a bottom opening 24 for receiving a neck of a wearer when the shell is positioned on the head of the wearer. The shell 12 also has a front opening 26 for positioning adjacent to a face of the wearer when the shell is worn by the wearer. The front opening 26 may be in communication with the bottom opening 24, or may be separated by a chin shield that extends between the side portions 20, 22 of the shell 12. The shell 12 has an outer surface 28.

The invention may include a rear light transmitting assembly for transmitting light therefrom, which is mounted on the rear portion 16 of the shell. The rear light transmitting assembly may transmit a red light.

The invention may also include a forward light transmitting assembly 32 for transmitting light therefrom, which is mounted on the front portion 18 of the shell. The forward light transmitting assembly 32 may transmit a yellow light.

The invention may also include a top light transmitting assembly 34 for transmitting light therefrom, which is mounted on the top portion of the shell.

The invention may also include at least one side light transmitting assembly 36 for transmitting light therefrom, which is mounted on one of the side portions 20, 22 of the shell. In one embodiment, a side light transmitting assembly 36, 37 is located on each of the side portions 20, 22 of the shell.

Each or some of the light transmitting assemblies may extend outwardly from the outer surface of the shell (see FIG. 4) for facilitating visibility of the light transmitting assembly from viewpoints lateral to the portion of the outer surface 28 of the shell 12 on which the particular light transmitting assembly is mounted. For example, in embodiments of the invention in which the rear light transmitting assembly extends outwardly from the outer surface of the shell, the rear light transmitting assembly is more highly visible from viewpoints lateral to the shell.

Optionally, each or some of the light transmitting assemblies may be substantially flush to the outer surface of the shell (see FIG. 5), which may restrict the overall visibility of the light transmitting assembly from more peripheral areas but may also decrease any possible confusion as to which light transmitting assembly is being viewed in low light conditions.

In some embodiments of the invention each or some of the light transmitting assemblies include a reflector 38 that reflects light that is direct toward the light transmitting assembly. The reflector may include one or more reflective surfaces, including multifaceted reflective surfaces oriented in various different directions. In other embodiment of the invention, each or some of the light transmitting assemblies include a light producing device 39, which may comprise a light bulb or light emitting diode or other light emitting component.

The invention may also include a message indication assembly 40 mounted on the shell 12 for indicating a user selected message that is viewable by those around the wearer. The message indicating assembly 40 may be positioned on the rear portion of the shell and directed rearwardly such that when the head wear is worn by the wearer, persons behind the wearer is able to view messages displayed by the message indication assembly. The message indicating assembly 40 may include a display 42 capable of displaying alphanumeric characters and symbols, and the display may be oriented in a direction extending rearwardly from the shell for permitting a person behind the wearer to view the display. The display 42 may comprise a screen formed of a plurality of elements which may be light emitting elements or light reflective elements. For example, light emitting diodes may comprise the screen of the display.

The message indication assembly may also include a controller 44 for controlling the display, and the screen thereof. The controller 44 may include circuitry required to operate, or "drive", the elements of the screen. Further, the controller 44 may include circuitry capable of or programmed to scroll characters, such as alphanumeric characters, across the screen of the display. Optionally, a keyboard or keypad 46 may be provided for programming a message or other symbols for display on the display 42, and/or an electrical data connector 48 (such as a serial or parallel data bus connector) may be located on the headgear for selectively connecting to a computing device to download display data to the controller.

The invention may also include a power source 50 for providing power to the light transmitting assemblies. The power source 50 may be mounted on the shell. The power source 50 may comprise a rechargeable battery that may be recharged from an exterior power source, and may provide a power output of approximately 12 volts.

The invention may also include flashing circuitry 52 for intermittently supplying power to the light transmitting assembly or assemblies for producing an intermittent flashing of light produced by the light transmitting assembly. It will be recognized that the flashing circuitry is most suitable for use with light transmitting assemblies that employ light emitting elements. The flashing circuitry may be electrically connected between the power source 50 and the light transmitting assembly or assemblies.

A switch 54 may also be included for selectively providing power from the power source 50 to the light transmitting assembly or assemblies and the associated circuitry.

In use, a person places the shell of the headgear on his or her head and activates the switch to provide power to the light transmitting assemblies when enhanced visibility is desired, and the message indication assembly may be triggered through a switch when a message is to be displayed thereon.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. Headgear comprising:

a shell having a top portion for positioning adjacent to a top of the head of a wearer when the shell is worn by the wearer, a rear portion extending downwardly from the top portion for positioning adjacent to a rear of the head of a wearer when the shell is worn by the wearer, a front portion extending downwardly from the top portion, and laterally-spaced side portions extending downwardly from the top portion and forwardly from the rear portion for positioning adjacent to sides of the head of the wearer when worn, the shell having an outer surface;

a top light transmitting means for transmitting light therefrom, the top light transmitting means being mounted on the top portion of the shell;

a message indication means mounted on the shell, the message indicating means being positioned on the rear portion of the shell; and a rear light transmitting means for transmitting light therefrom, the rear light transmitting means being mounted on the rear portion of the shell.

2. The headgear of claim 1 wherein the light transmitting means extends outwardly from the outer surface of the shell for facilitating visibility of the light transmitting means from lateral sides with respect to the shell.

3. The headgear of claim 1 wherein the rear light transmitting means comprises a reflector.

4. The headgear of claim 1 wherein the rear light transmitting means comprises a light producing device.

5. The headgear of claim 1 wherein the rear light transmitting means transmits red light.

6. The headgear of claim 1 additionally comprising a side light transmitting means for transmitting light therefrom, the side light transmitting means being mounted on each of the side portions of the shell.

7. The headgear of claim 1 additionally comprising flashing means for intermittently supplying power to the light transmitting means for producing an intermittent flashing of light by the light transmitting means.

8. The headgear of claim 1 additionally comprising a forward light transmitting means for transmitting light therefrom, the forward light transmitting means being mounted on the front portion of the shell.

9. The headgear of claim 8 wherein the forward light transmitting means transmits yellow light.

10. The headgear of claim 1 additionally comprising a power source for providing power to the light transmitting means, the power source being mounted on the shell.

11. The headgear of claim 10 wherein the power source comprises a rechargeable battery.

12. The headgear of claim 1 wherein the shell has a bottom opening for receiving a neck of a wearer when the shell is positioned on the head of the wearer.

13. The headgear of claim 12 wherein the shell has a front opening for positioning adjacent to a face of the wearer when the shell is worn by the wearer.

14. The headgear of claim 13 wherein the front opening is in communication with the bottom opening.

15. The headgear of claim 1 wherein the message indicating means includes a display capable of displaying alphanumeric characters, the display being oriented in a direction extending rearwardly from the shell for permitting a person behind the wearer to view the display.

16. The headgear of claim 15 wherein the message indicating means includes a controller for controlling the display.

17. The headgear of claim 16 wherein the controller includes scrolling means for scrolling alphanumeric characters across the display.

18. Headgear comprising:

a shell having a top portion for positioning adjacent to a top of the head of a wearer when the shell is worn by the wearer, a rear portion extending downwardly from the top portion for positioning adjacent to a rear of the head of a wearer when the shell is worn by the wearer, a front portion extending downwardly from the top portion, and laterally-spaced side portions extending downwardly from the top portion and forwardly from the rear portion for positioning adjacent to sides of the head of the wearer when worn, the shell having an outer surface;

a top light transmitting means for transmitting light therefrom, the top light transmitting means being mounted on the top portion of the shell;

a message indication means mounted on the shell, the message indicating means being positioned on the rear portion of the shell; and a forward light transmitting means for transmitting light therefrom, the forward light transmitting means being mounted on the front portion of the shell.

19. The headgear of claim 18 wherein the message indicating means includes a display capable of displaying alphanumeric characters, the display being oriented in a direction extending rearwardly from the shell for permitting a person behind the wearer to view the display.

20. The headgear of claim 18 additionally comprising flashing means for intermittently supplying power to the light transmitting means for producing an intermittent flashing of light by the light transmitting means.

21. Headgear comprising:

a shell having a top portion for positioning adjacent to a top of the head of a wearer when the shell is worn by the wearer, a rear portion extending downwardly from the top portion for positioning adjacent to a rear of the head of a wearer when the shell is worn by the wearer, a front portion extending downwardly from the top portion, and laterally-spaced side portions extending downwardly from the top portion and forwardly from the rear portion for positioning adjacent to sides of the head of the wearer when worn, the shell having an outer surface;

a top light transmitting means for transmitting light therefrom, the top light transmitting means being mounted on the top portion of the shell;

a message indication means mounted on the shell, the message indicating means being positioned on the rear portion of the shell; and a side light transmitting means for transmitting light therefrom, the side light transmitting means being mounted on each of the side portions of the shell.

22. The headgear of claim 21 wherein the message indicating means includes a display capable of displaying alphanumeric characters, the display being oriented in a direction extending rearwardly from the shell for permitting a person behind the wearer to view the display.

23. The headgear of claim 21 additionally comprising flashing means for intermittently supplying power to the light transmitting means for producing an intermittent flashing of light by the light transmitting means.

24. Headgear the headgear comprising:

a shell having a top portion for positioning adjacent to a top of the head of a wearer when the shell is worn by the wearer, a rear portion extending downwardly from the top portion for positioning adjacent to a rear of the head of a wearer when the shell is worn by the wearer, a front portion extending downwardly from the top portion, and laterally-spaced side portions extending downwardly from the top portion and forwardly from the rear portion for positioning adjacent to sides of the head of the wearer when worn, the shell having a bottom opening for receiving a neck of a wearer when the shell is positioned on the head of the wearer, the shell having a front opening for positioning adjacent to a face of the wearer when the shell is worn by the wearer, the front opening being in communication with the bottom opening, the shell having an outer surface;

a rear light transmitting means for transmitting light therefrom, the rear light transmitting means being mounted on the rear portion of the shell, the rear light transmitting means transmitting red light, wherein the rear light transmitting means extends outwardly from the outer surface of the shell for facilitating visibility of the rear light transmitting means from lateral sides with respect to the shell;

wherein the rear light transmitting means comprises a light producing device;

a forward light transmitting means for transmitting light therefrom, the forward light transmitting means being mounted on the front portion of the shell, the forward light transmitting means transmitting yellow light, wherein the forward light transmitting means extends outwardly from the outer surface of the shell for facilitating visibility of the forward light transmitting means from lateral sides with respect to the shell;

wherein the forward light transmitting means comprises a light producing device;

a top light transmitting means for transmitting light therefrom, the top light transmitting means being mounted on the top portion of the shell, wherein the top light transmitting means extends outwardly from the outer surface of the shell for facilitating visibility of the top light transmitting means from lateral sides with respect to the shell;

wherein the top light transmitting means comprises a reflector;

a side light transmitting means for transmitting light therefrom, the side light transmitting means being mounted on each of the side portions of the shell, wherein the side light transmitting means comprises a pair of reflectors with one of the reflectors being mounted on each of the side portions of the shell;

wherein the side light transmitting means comprises a pair of side light producing devices with each of the light producing devices being mounted on each of the side portions;

a message indication means mounted on the shell, the message indicating means being positioned on the rear portion of the shell, the message indicating means comprising:

a display capable of displaying alphanumeric characters, the display being oriented in a direction extending rearwardly from the shell for permitting a person behind the wearer to view the display; and a controller for controlling the display, the controller including scrolling means for scrolling alphanumeric characters across the display;

a power source for providing power to the light transmitting means, the power source being mounted on the shell, the power source comprising a rechargeable battery, the power source providing power of 12 volts;

flashing means for intermittently supplying power to the light transmitting means for producing an intermittent flashing of light by the light transmitting means, the flashing means being electrically connected between the power source and the light transmitting means; and a switch for selectively providing power from the power source to the light transmitting means.

* * * * *